US008322630B2

(12) United States Patent
Richardson et al.

(10) Patent No.: US 8,322,630 B2
(45) Date of Patent: Dec. 4, 2012

(54) TRIGGER PUMP SPRAYER

(75) Inventors: James Samuel Richardson, Morden (GB); Robin Lefebvre, Antwerp (BE); Victor Klabbers, Brussels (BE); Elizabeth Jackson Glass, Cincinnati, OH (US); Michael Alan John Moss, Woluwe-St-Pierre (BE); Mitsuaki Shaduki, Yamaguchi (JP)

(73) Assignee: The Procter & Gamble Company, Cincinnati, OH (US)

( * ) Notice: Subject to any disclaimer, the term of this patent is extended or adjusted under 35 U.S.C. 154(b) by 319 days.

(21) Appl. No.: 12/776,582

(22) Filed: May 10, 2010

(65) Prior Publication Data

US 2011/0272493 A1 Nov. 10, 2011

(51) Int. Cl.
*B05B 9/043* (2006.01)

(52) U.S. Cl. ..... 239/333; 239/601; 222/383.1; 222/340

(58) Field of Classification Search ..... 239/333, 239/601; 222/383.1, 340
See application file for complete search history.

(56) References Cited

U.S. PATENT DOCUMENTS

| | | | |
|---|---|---|---|
| 3,768,734 | A | 10/1973 | Anderson, Jr. et al. |
| 4,503,998 | A | 3/1985 | Martin |
| 4,691,849 | A | 9/1987 | Tada |
| 4,819,835 | A | 4/1989 | Tasaki |
| 4,940,186 | A | 7/1990 | Tada |
| 5,156,304 | A | 10/1992 | Battegazzore |
| 5,228,602 | A | 7/1993 | Maas et al. |
| 5,234,166 | A | 8/1993 | Foster et al. |
| 5,318,206 | A | 6/1994 | Maas et al. |
| 5,341,965 | A | 8/1994 | Maas et al. |
| 5,358,179 | A | 10/1994 | Lund et al. |
| 5,385,302 | A | 1/1995 | Foster et al. |
| 5,425,482 | A | 6/1995 | Foster et al. |
| 5,467,900 | A | 11/1995 | Maas et al. |
| 5,507,437 | A | 4/1996 | Foster et al. |
| 5,509,608 | A | 4/1996 | Foster et al. |
| 5,513,800 | A | 5/1996 | Foster et al. |
| 5,549,249 | A | 8/1996 | Foster et al. |

(Continued)

FOREIGN PATENT DOCUMENTS

| | | |
|---|---|---|
| EP | 1317963 | 6/2003 |

(Continued)

OTHER PUBLICATIONS

U.S. Appl. No. 12/776,606, filed May 10, 2010, Richardson, et al.

(Continued)

*Primary Examiner* — Steven J Ganey
(74) *Attorney, Agent, or Firm* — Larry L. Huston; Leonard W. Lewis

(57) ABSTRACT

A trigger pump sprayer in combination with a liquid dispensed from the sprayer. The trigger sprayer provides for efficacious particle size distributions of the liquids, when sprayed under non-ideal conditions. Non-ideal conditions include only partial strokes of the trigger, rather than full strokes and relatively slow trigger strokes. A bimodal distribution of particle sizes is obtained under two different operating conditions. The sprayer/liquid combination according to the present invention compresses the difference between the two modes, without requiring undue work by the operator. The advantageous particle size distribution difference is accomplished by using a precompression piston which reciprocates in response to trigger strokes, and selecting a liquid having appropriate properties to correspond to the trigger pump operating characteristics.

13 Claims, 18 Drawing Sheets

U.S. PATENT DOCUMENTS

| | | | |
|---|---|---|---|
| 5,551,636 | A | 9/1996 | Foster et al. |
| 5,553,752 | A | 9/1996 | Foster et al. |
| 5,566,885 | A | 10/1996 | Foster et al. |
| 5,615,835 | A | 4/1997 | Nelson |
| 5,628,434 | A | 5/1997 | Foster et al. |
| 5,628,461 | A | 5/1997 | Foster et al. |
| 5,645,221 | A | 7/1997 | Foster |
| RE35,744 | E | 3/1998 | Foster et al. |
| 5,730,335 | A | 3/1998 | Maas et al. |
| 5,839,621 | A | 11/1998 | Tada |
| 5,884,845 | A | 3/1999 | Nelson |
| 5,984,149 | A | 11/1999 | Thanisch et al. |
| 6,116,472 | A | 9/2000 | Wanbaugh et al. |
| 6,131,820 | A | 10/2000 | Dodd |
| 6,234,361 | B1 | 5/2001 | Bloom |
| 6,287,841 | B1 | 9/2001 | Mulleners et al. |
| 6,425,501 | B1 | 7/2002 | Keung et al. |
| 6,910,605 | B2 | 6/2005 | Schuckmann et al. |
| 7,017,833 | B2 | 3/2006 | Foster |
| 7,175,056 | B2 | 2/2007 | Buti |
| 7,219,848 | B2 | 5/2007 | Sweeton |
| 7,410,079 | B2 | 8/2008 | Kuwahara et al. |
| 7,413,134 | B2 | 8/2008 | Tsuchida |
| 7,467,752 | B2 | 12/2008 | Sweeton |
| 7,497,358 | B2 | 3/2009 | Clynes et al. |
| 7,571,836 | B2 | 8/2009 | Foster et al. |
| 7,775,405 | B2 * | 8/2010 | Sweeton et al. ..... 239/333 |
| 2006/0138176 | A1 | 6/2006 | Lasserre et al. |

FOREIGN PATENT DOCUMENTS

| | | | |
|---|---|---|---|
| EP | 2233213 | A1 | 9/2010 |
| JP | 2003/200087 | A2 | 7/2003 |
| WO | WO 2011/077114 | A1 | 6/2011 |

OTHER PUBLICATIONS

U.S. Appl. No. 12/562,534, filed Sep. 18, 2009, Williams, Kristin Rhedrick.

* cited by examiner

TRIGGER PUMP SPRAYER

FIELD OF THE INVENTION

The present invention relates to pump sprayers and more particularly to pump sprayers which can provide a preferred particle size distribution under real world operating conditions.

BACKGROUND OF THE INVENTION

Trigger sprayers are well-known in the art. Trigger sprayers utilize a handheld reservoir, typically depending from a manual pump. The reservoir may hold any liquid desired to be sprayed in a stream, fine droplets, foam or mist. The liquid may comprise an air freshener, fabric refresher, hair spray, cleanser, etc.

The pump is activated by an articulating trigger. The user squeezes the trigger with his or her hand, typically retracting the trigger from a forward resting position to a rearward dispensing position. The motion of the trigger causes pumping of the liquid from the reservoir and ultimate spraying thereof.

The characteristics of the spray, e.g. stream, droplets, mist, are determined by several parameters and operating characteristics of the pump. For example, the nozzle geometry, piston bore, piston stroke and pump efficiency will all affect the spray characteristics.

The situation is complicated if a pump designed for one particular liquid is used with a different liquid. The liquid rheology, surface tension, etc. also affect the spray characteristics.

The situation is further complicated by user operation. The pump may be designed and intended to be used with full trigger strokes, each stroke dispensing a full volume of the piston displacement at a particular stroke speed. However, the user may not always, or ever, operate the trigger in the intended manner.

If the piston bore is too large, the force necessary to achieve proper trigger stroke may be too great for a particular user. If the piston stroke is too long or if the trigger articulation is too long, the user may not pull the trigger for the entire intended path length. If the user's hand is too small or too large, the user may not operate the trigger as intended. The user may operate the trigger slower or faster than intended. The user's hand may fatigue and operation may change in the middle of a particular usage and even mid-stroke.

Thus, there is a need in the art to accommodate not only intended use conditions for a particular liquid, but real-world conditions as well.

U.S. Pat. No. 3,768,734 to Anderson Jr. et. al. (Arrowhead Products); U.S. Pat. No. 4,503,998 to Martin (Universal dispensing Systems); U.S. Pat. No. 4,691,849 to Tada; U.S. Pat. No. 4,819,835 to Tasaki (Yoshino); U.S. Pat. No. 4,940,186 to Tada; U.S. Pat. No. 5,156,304 to Battegazzore (Guala) teaching a spraying device having a rocker lever for converting angular trigger motion to pump displacement; U.S. Pat. No. 5,299,717 to Geier (CoCoster Tecnologie Speciali) teaching a manual spray device having the axis of the piston generally parallel to the motion of the trigger; U.S. Pat. No. 5,318,206 to Maas et al. (AFA Products); U.S. Pat. No. 5,385,302 to Foster et al. (Contico Int'l) teaching a trigger sprayer having a pump assembly parallel to the discharge path; U.S. Pat. No. 5,570,840 to Gettinger (Fourth and Long) teaching a spraying device having first and second pumps; U.S. Pat. No. 5,575,407 Foster et al. (Contico Int'l); U.S. Pat. No. 5,593,093 to Foster et al. (Contico Int'l); U.S. Pat. No. 5,645,221 to Foster (Contico Int'l); U.S. Pat. No. 5,628,434 to Foster et al. (Contico Int'l); U.S. Pat. No. 5,628,461 to Foster et al. (Contico Int'l); U.S. Pat. No. 5,884,845 to Nelson (Continental Sprayers) U.S. Pat. No. 6,244,473 to Keung et al. (Owens Illinois Closure); 2009/0008415 A1 to Ohshima (Mitani Valve); Re. 35,744, reissued Mar. 17, 1998 of U.S. Pat. No. 5,234,166 to Foster et al. (Contico Intl); U.S. Pat. No. 5,228,602 to Maas et al. (AFA Products); U.S. Pat. No. 5,341,965 to Maas et al. (AFA Products); U.S. Pat. No. 5,425,482 to Foster et al. (Contico Int'l); U.S. Pat. No. 5,467,900 to Maas et al. (AFA Products); U.S. Pat. No. 5,507,437 to Foster et al. (Contico Int'l); U.S. Pat. No. 5,509,608 Reexamination Certificate B1 (4195) to Foster et al. (Continental Sprayers); U.S. Pat. No. 5,513,800 to Foster et al. (Contico Int'l); U.S. Pat. No. 5,549,249 to Foster et al. (Contico Int'l); U.S. Pat. No. 5,551,636 to Foster et al. (Contico Int'l); U.S. Pat. No. 5,553,752, Reexamination Certificate C1 (4343), to Foster et al. (Contico et al); U.S. Pat. No. 5,566,885 to Foster et al. (Contico Int'l); U.S. Pat. No. 5,615,835 to Nelson (Contico Int'l); U.S. Pat. No. 5,730,335 issued to Maas et al. (AFA products); U.S. Pat. No. 5,984,149 to Thanisch et al. (Spraysol); U.S. Pat. No. 6,116,472 to Wanbaugh et al. (Calimar); U.S. Pat. No. 6,131,820 to Dodd (Calimar); U.S. Pat. No. 6,234,361 to Bloom (Owens Illinois Closure) U.S. Pat. No. 6,364,175 to Bloom (Owens Illinois Closure); U.S. Pat. No. 6,378,786 to Beeston et al. (Reckitt Benkiser); U.S. Pat. No. 6,425,501 to Keung et al. (Owens Illinois Closure); U.S. Pat. No. 6,910,605 to Schuckmann et al. (Schuckmann); U.S. Pat. No. 7,017,833 to Foster (Continental AFA Dispensing); U.S. Pat. No. 7,175,056 to Buti (Spray Plast); U.S. Pat. No. 7,219,848 to Sweeton (Meadwestvaco Calimar); U.S. Pat. No. 7,413,134 to Tsuchida (Yoshino Kogyosho); U.S. Pat. No. 7,410,079 to Kuwahara et al. (Yoshino Kogyosho); U.S. Pat. No. 7,467,752 to Sweeton (Meadwestvaco Calimar); U.S. Pat. No. 7,497,358 to Clynes et al. (Meadwestvaco Calimar); EP 7 757 984; WO 2009/078303; JP 2003-230854; EP 1317963; JP 2503986; and JP 2003-200087 show various attempts in the art.

SUMMARY OF THE INVENTION

The invention comprises a trigger sprayer suitable for dispensing liquid from a reservoir, through a nozzle into particles. The trigger sprayer advantageously minimizes the difference in the particle size distributions between ideal spray conditions which may be approximated at 90 full trigger strokes per minute and real-world spray conditions which may be approximated at 30 partial trigger strokes per minute.

BRIEF DESCRIPTION OF THE DRAWINGS

In FIGS. 7A-9B and 12, the number and error bar on the left designates the peak of the particle size distribution for a response at 90 full strokes of the trigger per minute. The number and error bar on the right designates the peak of the particle size distribution and error for a response at 30 partial strokes of the trigger per minute, stroking from the rest position to one-third of the full stroke distance. The center box represents the difference between the peaks at 90 and 30 strokes per minute.

FIG. 7A is a graphical representation of a Dv(50) bimodal particle size distribution for seven commercially available sprayers and one embodiment of the present invention using distilled water as the liquid being sprayed.

FIG. 9B is a graphical representation of a D[4,3] bimodal particle size distribution for seven commercially available sprayers and one embodiment of the present invention, using a test liquid.

FIG. 12 is a graphical representation of the Dv(50), Dv(90) and D[4,3] bimodal particle size distributions for two sprayers made according to WO 2009/078303 published Jun. 25, 2009, using distilled water as the liquid being sprayed. One sprayer has a 1.0 mL output per full stroke, one sprayer has a 1.3. mL output per full stroke.

All figures are drawn to scale unless specifically stated otherwise.

DETAILED DESCRIPTION OF THE INVENTION

Figure 1:
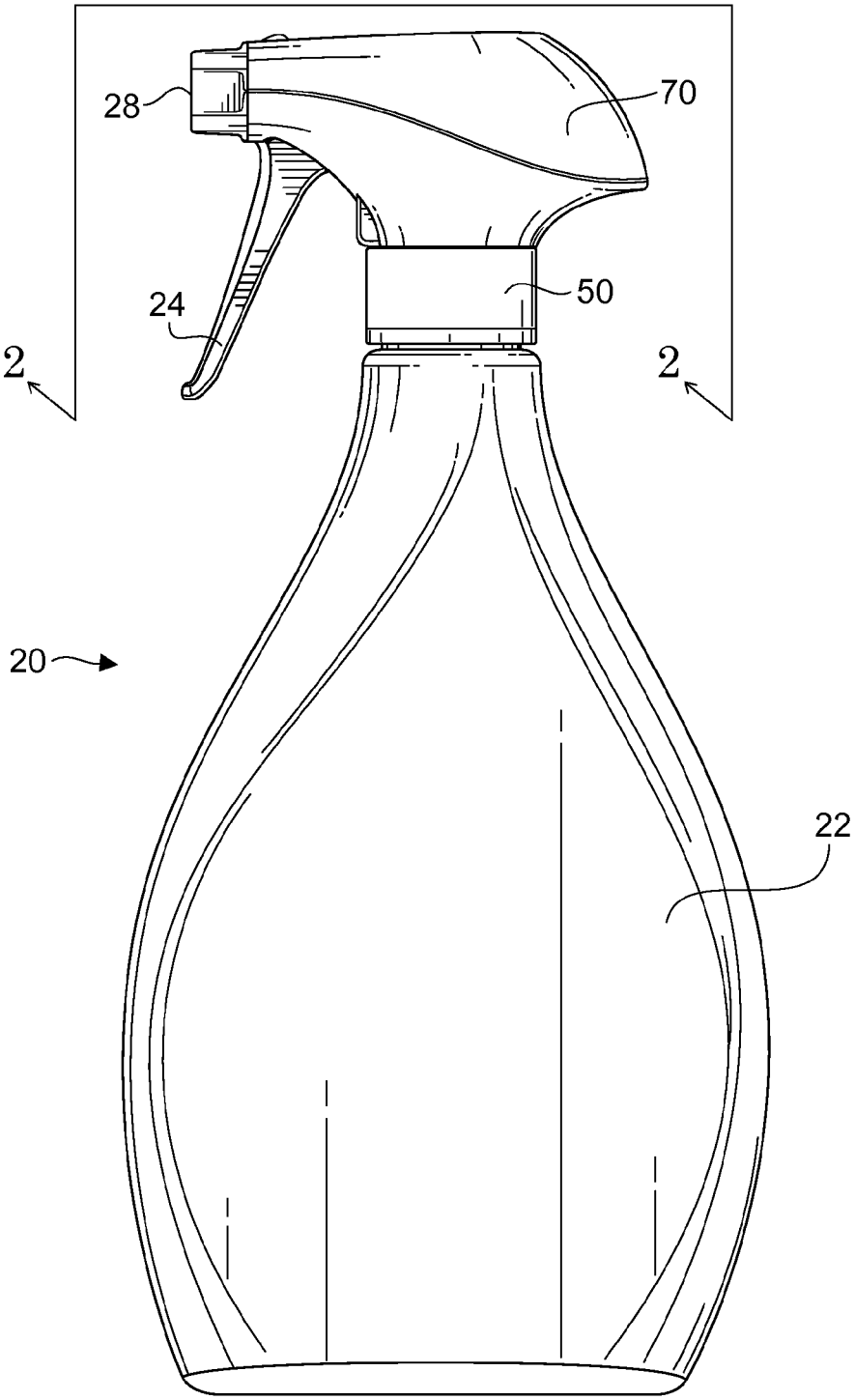
FIG. 1 is a perspective view of one embodiment of an illustrative sprayer according to the present invention.

Referring to FIG. 1, the invention comprises a trigger pump sprayer 20. The sprayer 20 may have a reservoir 22 suitable for holding liquid, a spray engine (not shown) operated by a trigger 24 and a spray nozzle 28 for dispensing liquid from the sprayer 20. The spray engine may be enclosed by a housing 70. The sprayer 20 and spray engine 26 may have a longitudinal axis, which is parallel to a portion of the fluid flow during dispensing.

Figure 2:
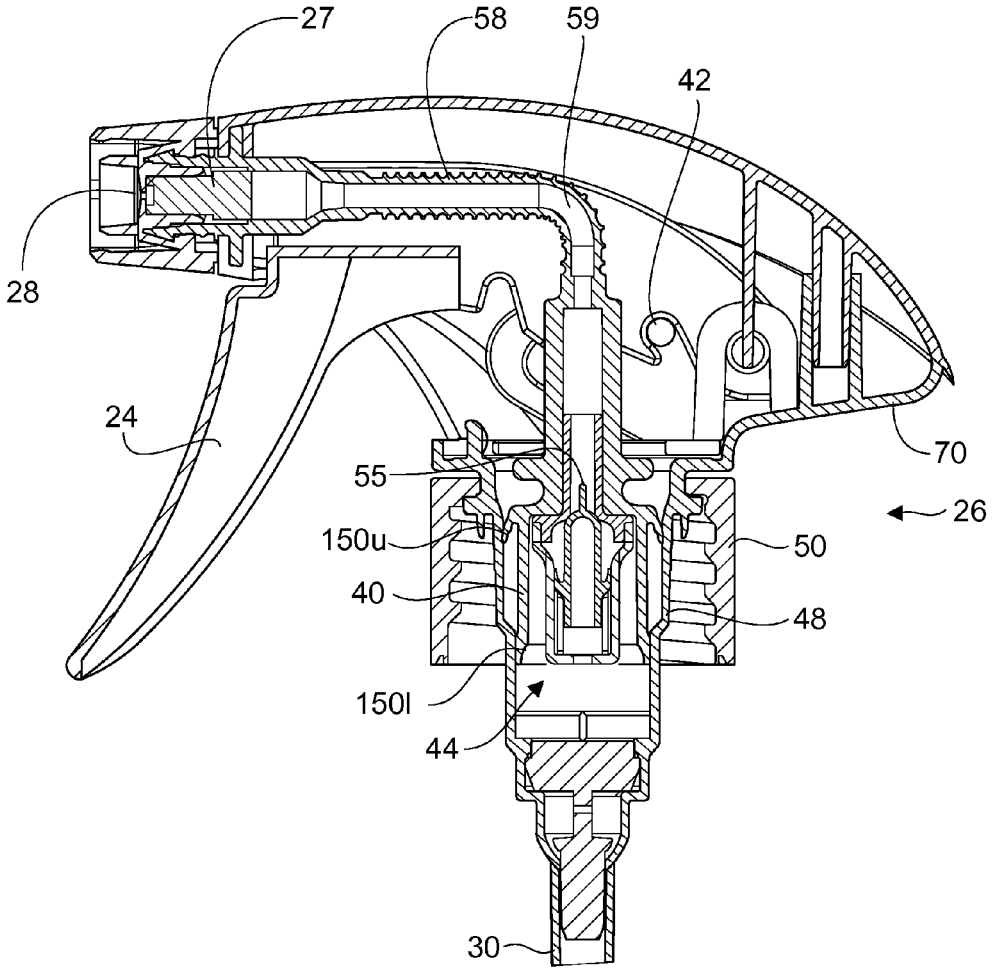
FIG. 2 is a fragmentary vertical sectional view taken along the lines 2-2 of FIG. 1, showing the spray engine with the trigger in the forward position.
Figure 3:
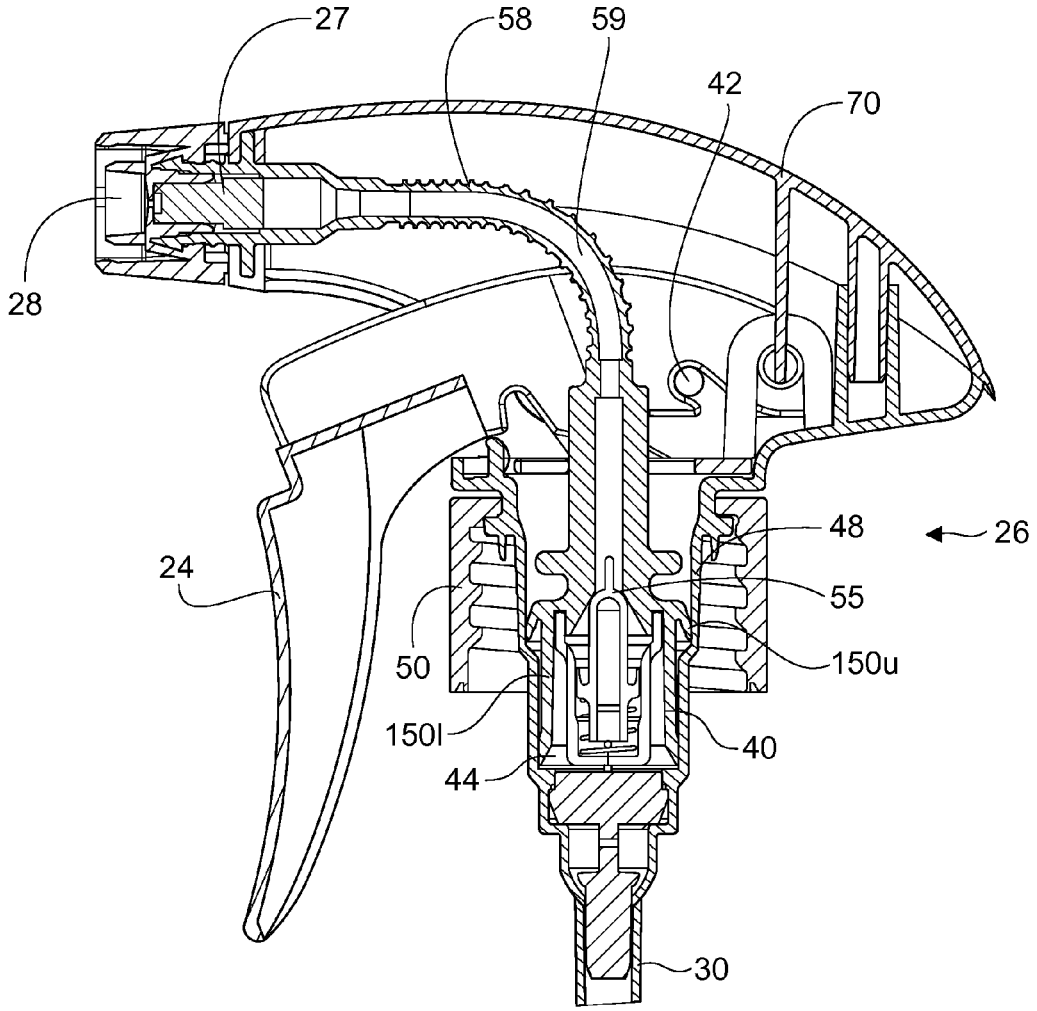
FIG. 3 is a fragmentary vertical sectional view of the spray engine of FIG. 2, showing the trigger in the rearward position.

Referring to FIGS. 2 and 3, the pump sprayer 20 may comprise a precompression trigger 24 sprayer 20. A single spray engine 26 can be utilized with various sizes and designs of reservoirs 22. A dip tube 30 extends from the engine 26 towards the bottom of the reservoir 22. Liquid contained in the reservoir 22 is drawn upwardly though the dip tube 30, in response to actuation by the trigger 24.

Manual actuation of the trigger 24 through its stroke causes corresponding vertical movement of a piston 40. Vertical movement of the piston 40 pumps liquid from the reservoir 22, through a flow path and out the nozzle 28. This embodiment of the pump sprayer 20 utilizes an articulating, top-pivoting trigger 24, although it is recognized that vertical push button type sprayers, as commonly used for hair spray, could be utilized as well.

A return spring 42 provides bias to urge the trigger 24 back to the forward position at the end of the stroke. Two curved parallel springs 42 may be utilized. The springs 42 may be connected at each end and may be disposed outside the piston 40/pump chamber 44. The vertically upwards flow path may be disposed between the springs 42.

The trigger 24 motion creates hydraulic pressure in the pump, causing the liquid to be dispensed. The liquid in the reservoir 22 is drawn vertically through a dip tube 30, and into the pump chamber 44. The return stroke creates a vacuum, drawing the liquid from the reservoir 22 to refill the pump chamber 44. A reciprocating piston 40 pressurizes the pump cylinder, and liquid drawn therein. This pressure causes the liquid to be sprayed out of the sprayer nozzle 28. A return spring 42 automatically alternates the trigger 24 to the forward rest position.

Referring to FIG. 3, as the trigger 24 is squeezed by the user to a rearward position, the motion of the trigger is converted to downward motion of the piston 44, within body 48. As the resisting forces within the system are overcome, valve 55 opens, allowing vertical flow.

Figure 4:
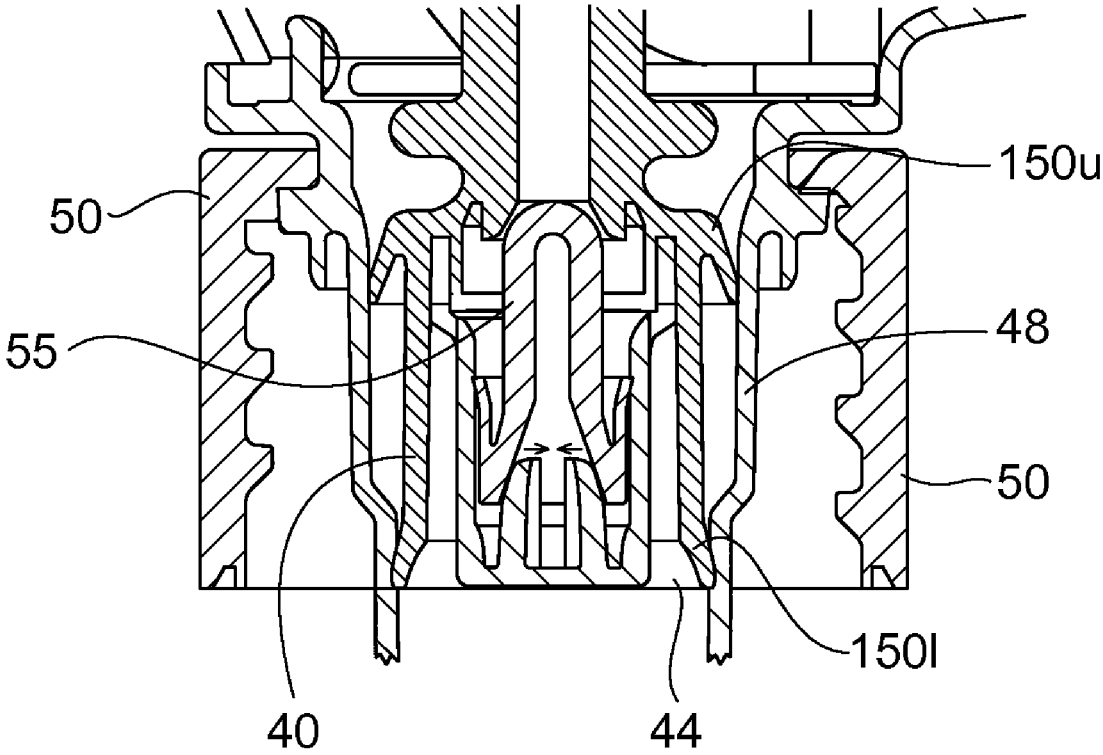
FIG. 4 is a fragmentary vertical sectional view of the piston assembly usable with the spray engine of FIGS. 2-3, showing the vertical flow path for dispensing of liquids.

Referring to FIG. 4, and examining the pump in more detail, a stepped body 48 may house the reciprocating piston 40. The stepped body 48 may be captured by a screw closure 50. The screw closure 50 may be opened to access and replenish liquid in the reservoir 22, as desired.

The reciprocating piston 40 may have an upper seal 150U and a lower seal 150L, both of which fit within the body 48. Actuation of the trigger 24 causes corresponding downward vertical movement of the piston 40. Liquid is drawn upwardly through the dip tube 30 and forced into the liquid chamber 44, where it remains until displaced upwardly into an annular chamber 44 intermediate the piston 40 and body 48.

A valve 55 disposed within the piston 40 may have vertical movement thereof resisted by a spring (not shown). As force from the trigger 24 motion increases the force applied to the piston 40 the valve 55 may move downwardly, pressurizing liquid in the chamber 44 to be later dispensed.

Referring back to FIGS. 2-3, the piston 40 movement allows the liquid to move upwardly into a passage, formed by a vertical tube 58. The tube 58 is flexible and bent at approximately 90 degrees. The flexible tube 58 bends at the elbow 59 in response to movement of the trigger 24/crank rocker, slightly increasing the angle at the elbow 59. The portion of the flexible tube 58 downstream of the elbow 59 bend terminates at a spinner 27.

Liquid flowing through the tube 58 passes through the spinner 27. The spinner 27 imparts a tangential rotation to the liquid before the liquid reaches the nozzle 28. The spinner 27 is inserted into the nozzle 28, up to the shoulder of the spinner 27. The spinner 27 and nozzle 28 are stationary. The spinner 27 may comprise a constant diameter pin with two longitudinal grooves disposed 180 degrees out on the downstream half of the axial length. The grooves terminate in a swirl chamber. The swirl chamber is disposed on the face of the spinner 27.

The spinner 27 may have two longitudinally opposed ends, an upstream end into which the aforementioned bent tube 58 is fitted and a downstream end which fits into the nozzle 28. The spinner 27 may have a length of about 11 mm and a stepped diameter of about 4-5 mm. The spinner 27 may have two longitudinally oriented slots equally circumferentially spaced around the downstream portion thereof.

Upon exiting the spinner 27 the liquid passes through the nozzle 28 for dispensing into the atmosphere or onto a target surface. The nozzle 28 may have a diameter of 0.5-6 mm, and be radiused on the outside face. The liquid is dispensed from the nozzle 28 in a predetermined spray pattern, which may vary according with the stroke speed, stroke length, etc. of the trigger 24 operation. Optionally, provision may be made for adjusting the spray pattern.

The entire pump assembly 26 may be encased in a multipart polypropylene housing 70. There may be no direct opening from the pump to the outside of the housing 70, except for the nozzle 28.

Figure 5:
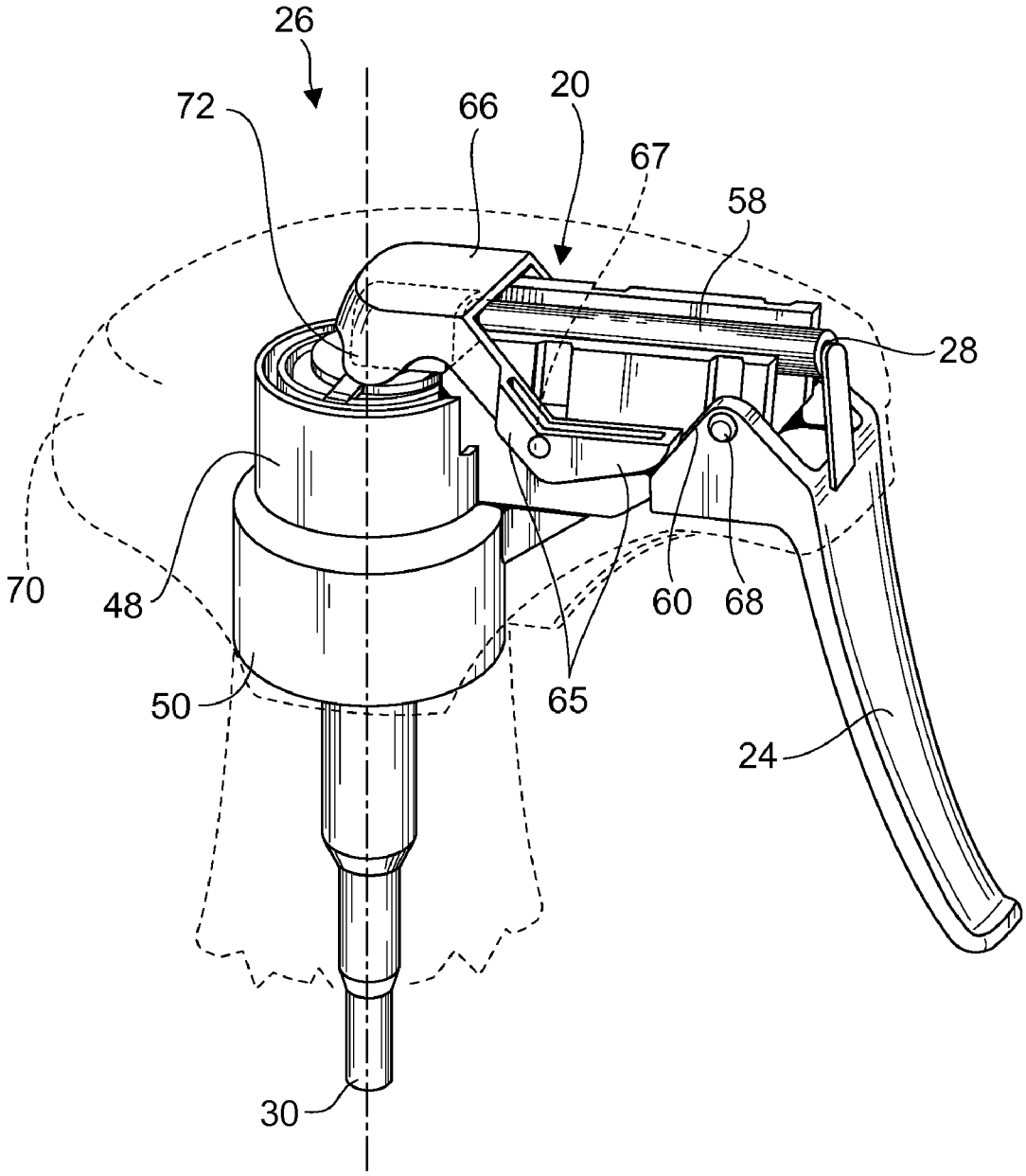
FIG. 5 is a perspective view of an alternative embodiment of a spray engine, having a crank rocker mechanism, showing the engine housing in phantom.
Figure 6:
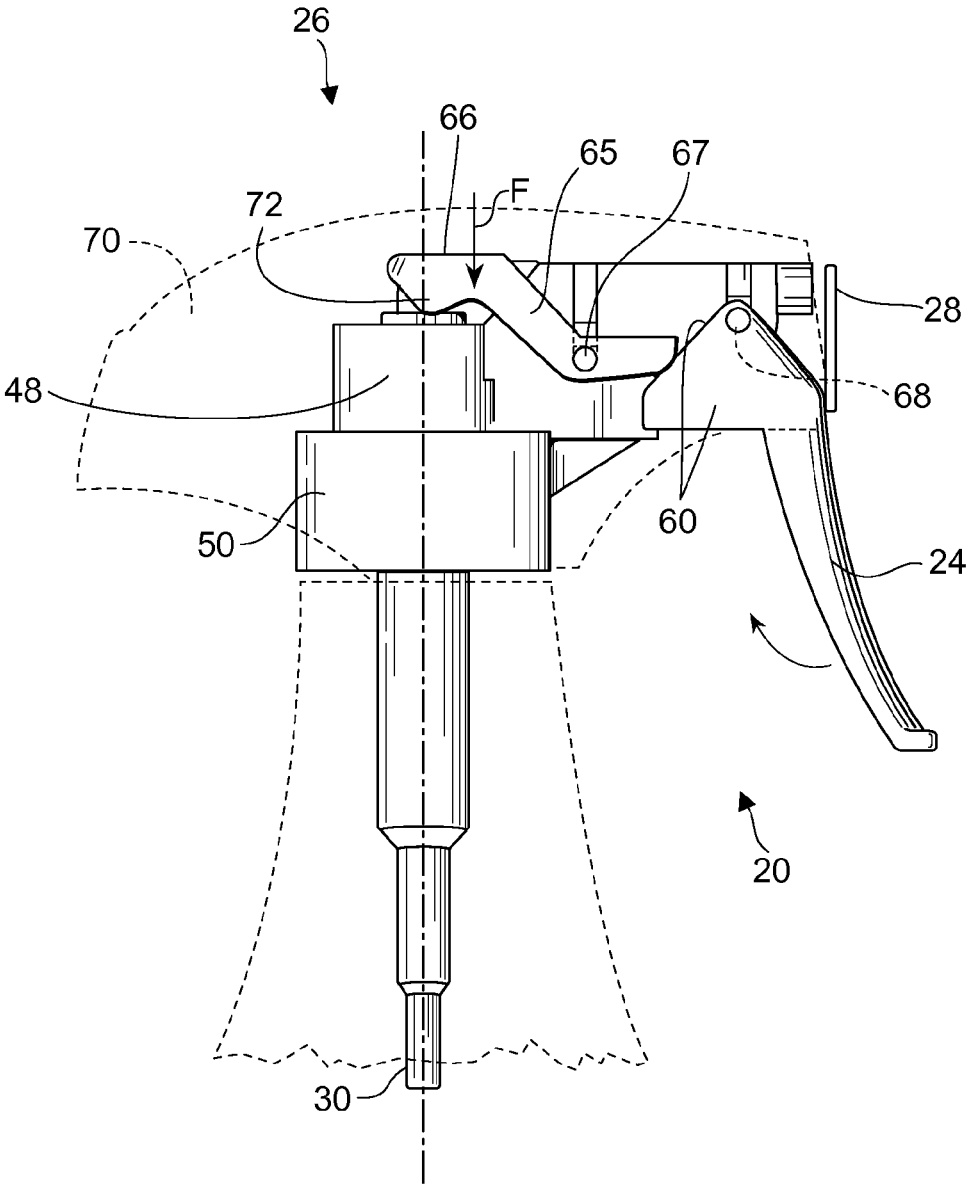
FIG. 6 is a profile view of the embodiment of FIG. 5.

Referring to FIGS. 5-6, the trigger 24 may be configured to provide travel which is more perpendicularly/radially oriented relative to the longitudinal axis than the geometry shown in FIGS. 2-3. This travel orientation may be accomplished by providing mounting trunions 68 disposed near the uppermost portion of the trigger 74. A rearward-facing protrusion 60 on the trigger 24 may pivot upwardly against a rocker arm 65 of an articulable crank rocker 66. The rocker arm 65 is mounted on two trunnions 67. The opposite end 72 of the crank rocker 66 articulates downwardly, to provide a force F aligned with or coincident the longitudinal axis. This force F displaces the piston 40 in the downward direction, pressurizing liquid in the pump cylinder 44. Referring back to FIG. 4, liquid in the lower portion of chamber 40 is displaced by the piston 40, flows upwardly through the annular portion of chamber 44, past valve 55 and into tube 38.

The embodiment of FIGS. 2-3 provides the advantage of fewer parts than the embodiment of FIGS. 5-6. The embodiment of FIGS. 5-6 may be utilized when a more horizontal trigger 24 motion is desired, providing desirable ergonomics.

A suitable pump sprayer 20 may be made according to the teachings of WO 2009/078303, published Jun. 25, 2009 (Canyon Co. Ltd). However, the sprayer 20 in this publication must be adjusted to provide the work, otherwise the consumer may not properly dispense the liquid therefrom. If the trigger 24 force is too great, stroke length too long or too short, One of ordinary skill may desire different particle size distributions of liquid dispensed using the sprayer 20 of the present invention. If the particles are too large, the liquid may simply fall onto the floor or form a wet spot, puddling on the target surface. If the particles are too small, they may not have enough surface area to be efficacious. For example, spray particles less than 50 microns in diameter may remain suspended indefinitely or until evaporation occurs.

The particle size diameter is determined using a Spraytec 2000 particle size analyzer, using Malvern RT Sizer 3.03 software. Both are available from Malvern Instruments, Ltd, UK.

A 300 mm lens is used, having minimum and maximum particle size detections of 0.10 and 900.00 microns, respectively. The spray nozzle is positioned 140 mm from the laser beam, using a 100 mm path length. A particulate refractive index of 1.33 and dispersant refractive index of 1.00 are selected. A residual of 0.41 is selected, with the extinction analysis Off and multiple scatter set to On. The Scatter start is set to 1, scatter end is set to 36, and scattering threshold is set to 1.

A linear servo-drive motor may be used to provide the desired trigger speed/stroke rate. The servo-drive motor is connected a sled, which, in turn, is connected to a load cell. The load cell captures the peak force. The load cell is connected to the proximal ends of an articulating link comprising two parallel arms. The distal end of the articulating parallel arms are joined by a cross bar. The cross bar, in turn, engages the trigger 24 of the sprayer to be tested. The sprayer 20 may be held rigidly, and the trigger 24 pulled from behind. The cross bar rides on the trigger to provide actuation force.

One of skill will consider the Dv(50) measurement, meaning that 50 percent of the particles have a mean particle diameter less than the value indicated. Likewise one of skill will consider the Dv(90) measurement, meaning that 90 percent of the particles have a mean particle diameter less than the value indicated.

One of skill may also consider the D[4,3] measurement. This measurement sums the individual particle diameters raised to the $4^{th}$ power, divided by the sum of the individual particle diameters raised to the $3^{rd}$ power. This measurement is independent of the actual number of particles under consideration in the measurement.

The measurements discussed relative to FIGS. 7A, 8A, 9A, 10A, 11A were made using distilled water as the liquid. The measurements discussed relative to FIGS. 7B, 8B, 9B, 10B, 11B were made using a fabric refreshing solution as a test liquid. The test liquid may be an aqueous, nonstaining composition comprising a malodor binding polymer, at least one aliphatic aldehyde. The test liquid may be made according to U.S. patent application Ser. No. 12/562,534 filed Sep. 18, 2009 in the names of Williams et al. The salient properties of the distilled water and test liquid are shown in Table 1 below.

TABLE 1

| Liquid | Surface Tension in mNewtons/meter | Kinematic Viscosity in Pascal * Seconds at 25 C. | Dynamic Viscosity In Centipoises at 25 C. |
|---|---|---|---|
| Distilled water | 72.2 | 8.94E−4 | 0.894 |
| Test liquid | 23.1 | 0.00114 | 1.14 |

FIGS. 7A-11B show test results for seven commercially available trigger sprayers and the instant invention. Table 2 provides the number of samples tested for each type of sprayer shown in FIGS. 7A-11B. One of ordinary skill will appreciate the error bands shown in the figures decrease as the number of samples tested likewise decreases.

TABLE 2

| Trigger Sprayer Designation | Sampling N = |
|---|---|
| AFA 1.35 ml | 3 |
| AFA 1.15 ml | 3 |
| Guala TS-1 Red | 1 |
| Calmar | 5 |
| Guala TS-2 | 2 |
| Guala TS-1 Green | 1 |

TABLE 2-continued

| Trigger Sprayer Designation | Sampling N = |
|---|---|
| Yoshino | 3 |
| Canyon 1.3 mL | 3 |
| Canyon 1.0 mL | 5 |
| Invention | 5 |

Table 3 provides certain operating parameters for the aforementioned sprayers 20, including stroke length, stroke output, the number of strokes necessary to achieve 5 mL of output from the sprayer 20. The volume of 5 mL was chosen as this volume approximates the least volume typically sprayed during a single usage.

TABLE 3

| Sprayer | Number of Full Strokes to obtain 5 mL | Number of one-third partial strokes to obtain 5 mL | Full Stroke Travel (m) | ⅓ Partial Stroke Travel (m) | Full Stroke Output (ml) | ⅓ Partial Stroke Output (ml) |
|---|---|---|---|---|---|---|
| AFA (1.15 ML) | 4.35 | 13.89 | 0.034 | 0.01 | 1.15 | 0.36 |
| AFA (1.35 ML) | 3.70 | 16.13 | 0.034 | 0.01 | 1.35 | 0.31 |
| CALMAR PRE-FRESH (1.43 ML) | 3.50 | 8.93 | 0.02 | 0.008 | 1.43 | 0.56 |
| Invention | 5.00 | 17.86 | 0.022 | 0.008 | 1.00 | 0.28 |
| GUALA TS-1 GREEN (0.7 ML) | 7.14 | 45.45 | 0.03 | 0.01 | 0.70 | 0.11 |
| GUALA TS-1 RED (0.7 ML) | 7.14 | 55.56 | 0.03 | 0.01 | 0.70 | 0.09 |
| GUALA TS-2 TRIGGER (0.85 ML) | 5.88 | 18.52 | 0.02 | 0.008 | 0.85 | 0.27 |
| YOSHINO TRIGGER (0.5 ML) | 10.00 | 19.23 | 0.022 | 0.008 | 0.50 | 0.26 |

FIGS. 7A-11B test sprayer 20 performance under two different operating conditions. The ideal operating condition may be approximately 90 strokes per minute (SPM) with a stroke traveling the entire path of the trigger 24. However, as discussed above, the user may not always, or ever, dispense the liquid at the ideal condition of 90 strokes per minute. Accordingly, a separate test was run at 30 strokes per minute utilizing only the first one-third of the travel.

As used herein, all references to tests and data at 30 strokes per minute were run with the trigger 24 traveling from the forward resting position to only one third of the articulation to full stroke position. The term strokes per minute and acronym SPM are used interchangeably.

Ideally, the 90 SPM test and 30 SPM test would have coincident particle size distributions. The coincidence would indicate no loss of performance when ideal conditions are adjusted for real world usage. However, in every case tested the particle size distribution increased when the 30 SPM one-third stroke condition was utilized. The stroke force was applied to the trigger 24 at a position 40 mm from the hinge about which the trigger 24 articulates.

The trigger sprayer 20 described and claimed herein is suitable for use with liquids having certain rheological properties ranging from those of distilled water to those of an air/fabric refreshing liquid. Particularly, the liquids suitable for use with the present invention may have a dynamic viscosity ranging from about 0.85 to about 1.1 centipoises at 25 degrees C. and a kinematic viscosity ranging from about 8.9 E-4 to about 0.001 Pascal*seconds. The liquids may have a surface tension ranging from about 20 to about 75 milliNewtons/meter at 25 degrees C.

Referring to FIGS. 7A-9B, the number at the left-hand side of the bar graph indicates the peak particle size distribution of the 90 SPM test. The number at the right-hand side of the bar graph indicates the peak particle size distribution of the 30 SPM one-third stroke test.

The error bands on the left and right sides of the bar graph indicate the widths of the particle size distributions about the respective peak values, between the lowest value measured and the highest value measured. The peak value is determined by the average value of the particle size distribution for that test, i.e. either 90 SPM or 30 SPM.

The number inside the bar graph indicates the difference between the 30 SPM one-third stroke peak particle size distribution and the 90 SPM particle size distribution. Perfect coincidence would be indicated by a value of zero inside the bar.

The values in parenthesis, to the right of the designated sprayer 20, indicates the volume dispensed in a full stroke of the trigger 24 of the respective sprayer 20. Volumes dispensed per stroke range from 0.5 to 1.4 mL. If the volume dispensed per stroke is too small, the user will have to engage in more trigger 24 actuations per use, potentially increasing time and frustration with each usage. If the volume dispensed per stroke is too large, the user will may potentially dispense too much product with each usage, and be unable to prevent undue wetting or overpowering perfume aromas.

Figure 7A:
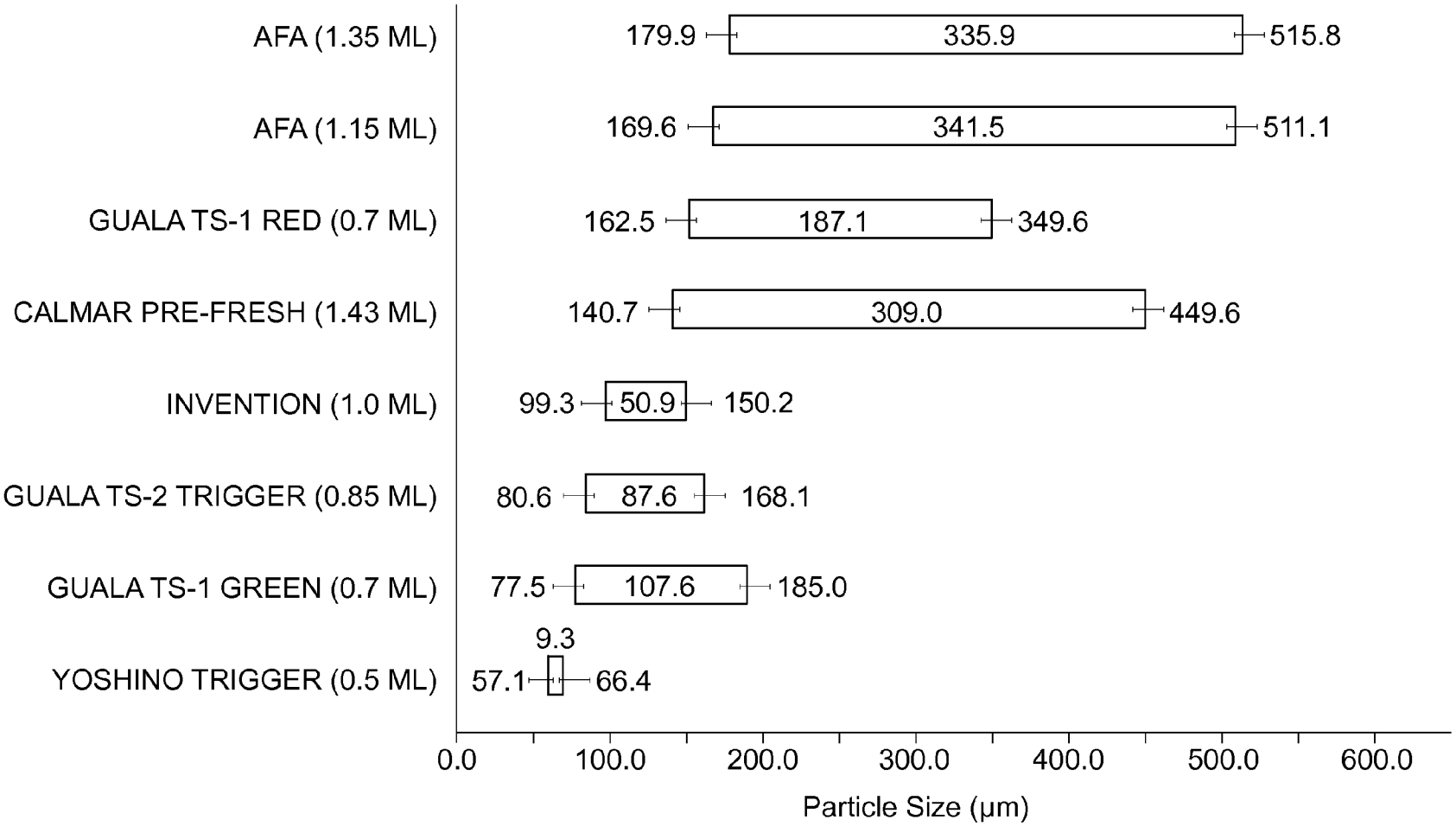
Figure 7B:
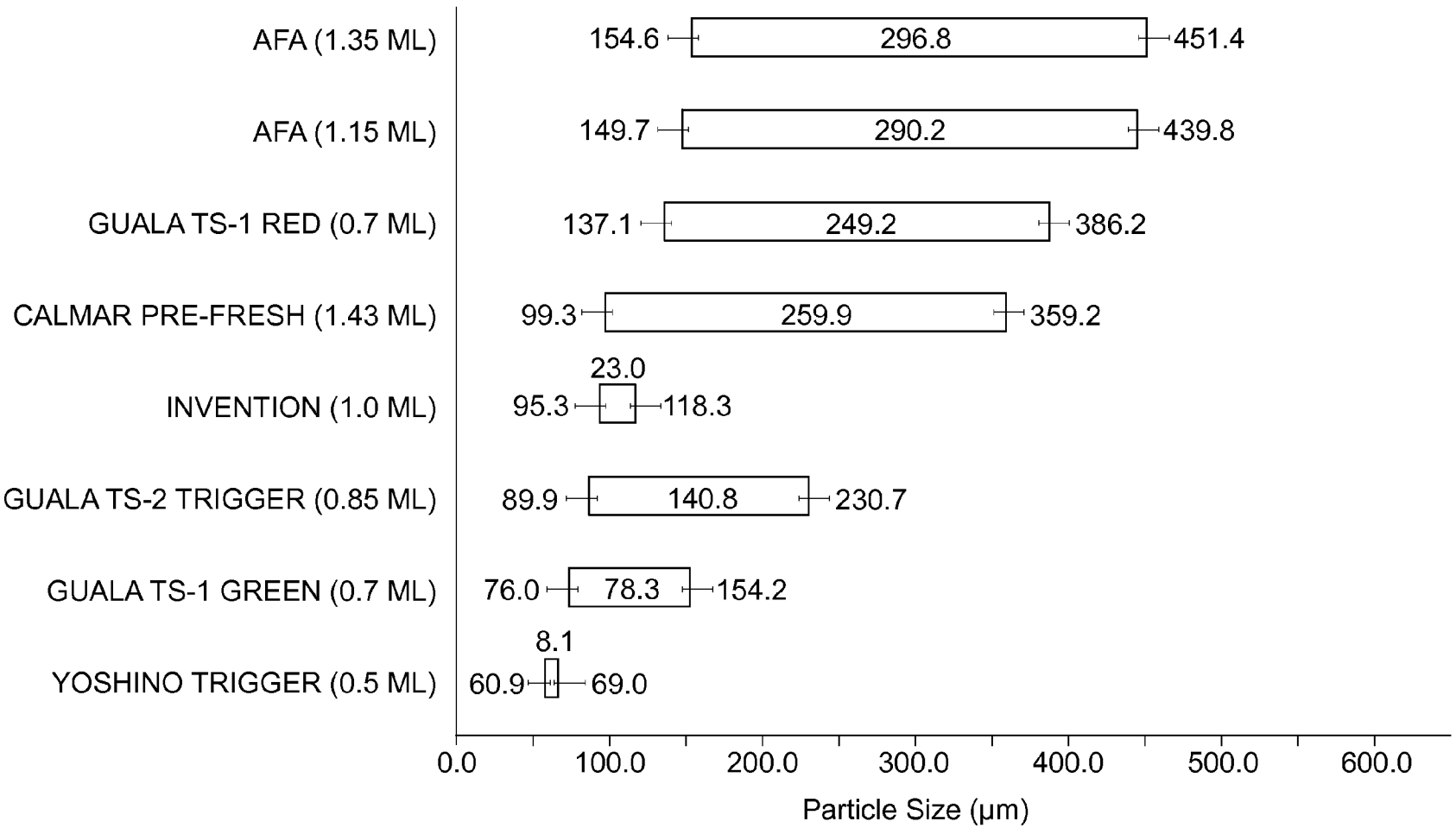
FIG. 7B is a graphical representation of a Dv(50) bimodal particle size distribution for seven commercially available sprayers and one embodiment of the present invention, using a test liquid.

Referring to FIGS. 7A, 7B, one of skill will note that the sprayer 20 according to the present invention has a difference in Dv(50) particle size distribution between the 30 SPM stroke test and 90 SPM test of 50.9 microns. This difference decreases to 23.0 microns with the test liquid. Thus, the performance of the sprayer 20 according to the present invention advantageously improves with at least one specific liquid of interest.

It is noted that the Yoshino sprayer had even less difference between the two tests than the sprayer 20 according to the invention. However, this sprayer 20 has the significant disadvantage that it only sprays out half of the volume, per stroke, of the present invention. Thus, the user may become more likely to experience fatigue of the hand when using the invention or not properly dispense enough liquid to be efficacious.

Figure 8A:
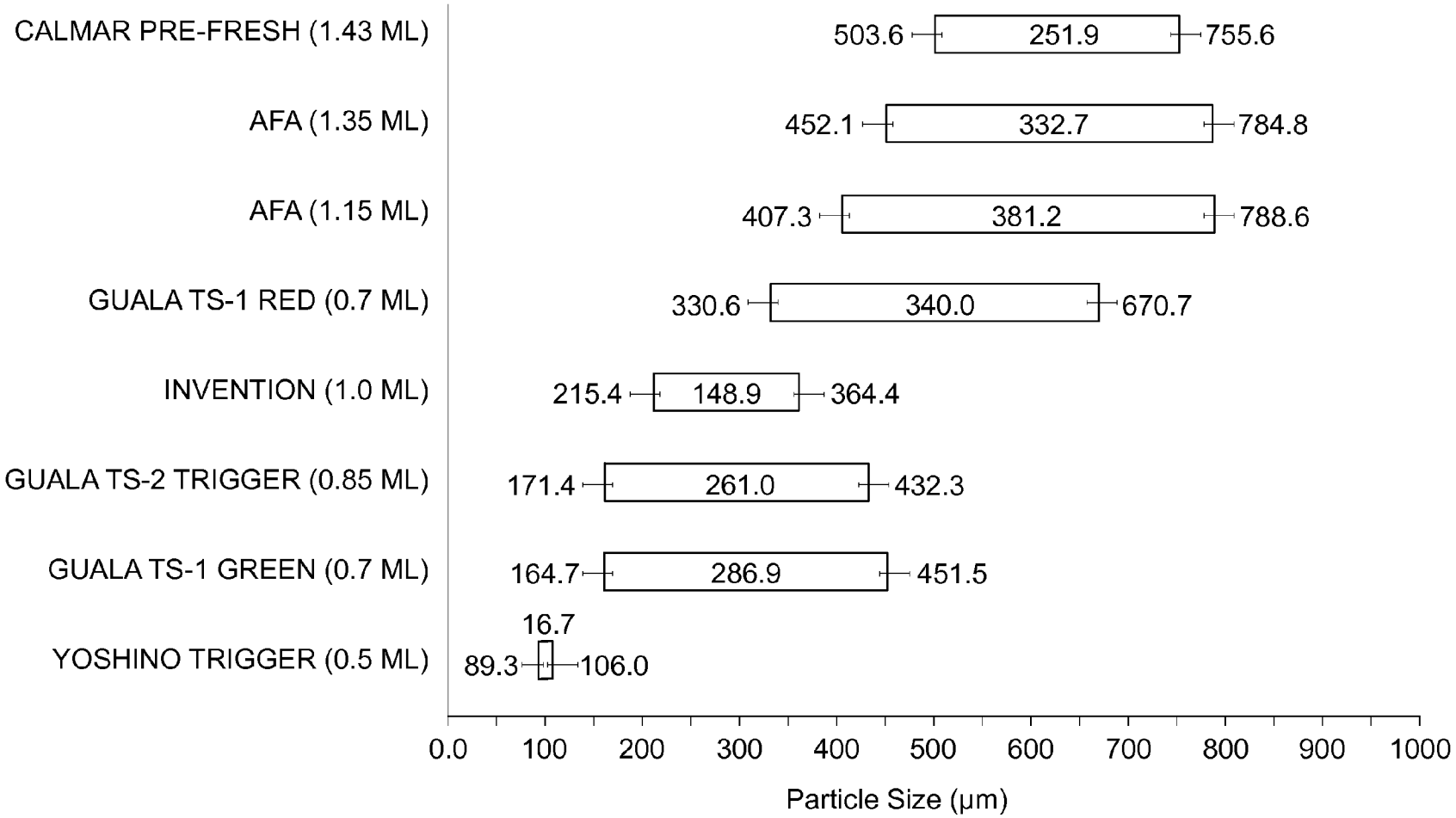
FIG. 8A is a graphical representation of a Dv(90) bimodal particle size distribution for seven commercially available sprayers and one embodiment of the present invention using distilled water as the liquid being sprayed.
Figure 8B:
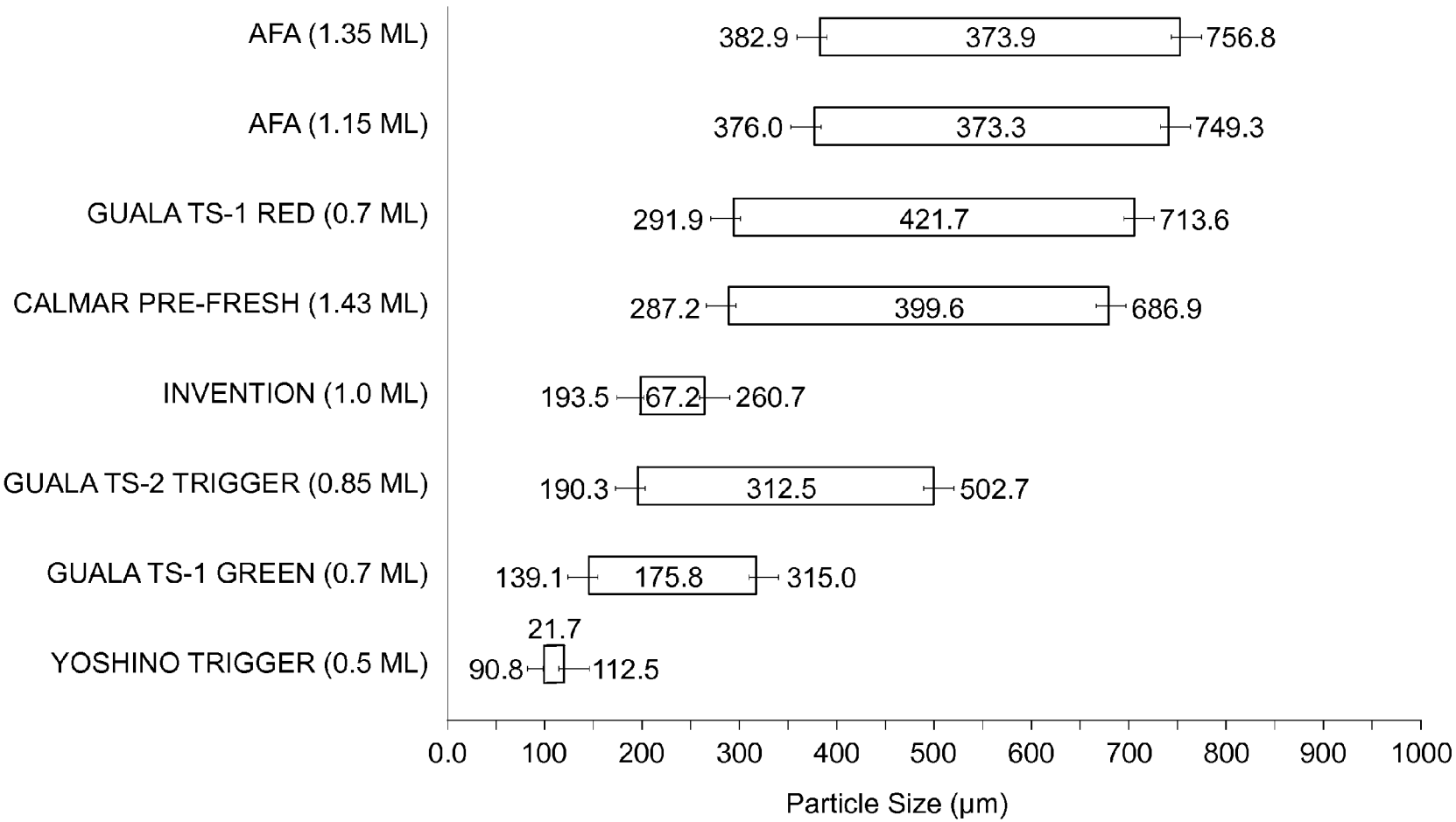
FIG. 8B is a graphical representation of a Dv(90) bimodal particle size distribution for seven commercially available sprayers and one embodiment of the present invention, using a test liquid.

Referring to FIGS. 8A, 8B, one of skill will note that the sprayer 20 according to the present invention has a difference in Dv(90) particle size distribution between the 30 SPM stroke test and 90 SPM test of 148.9 microns. This difference decreases to 67.2 microns with the test liquid. Thus, the performance of the sprayer 20 according to the present invention advantageously improves with at least one specific liquid of interest.

It is noted that the Yoshino sprayer 20 again had less difference between the two tests than the sprayer 20 according to the invention. However, again it is noted, this sprayer 20 has the significant disadvantage that it only sprays out half the volume, per stroke, of the present invention. Thus, the user may become more likely to experience fatigue of the hand when using the invention or not properly dispense enough liquid to be efficacious.

Figure 9A:
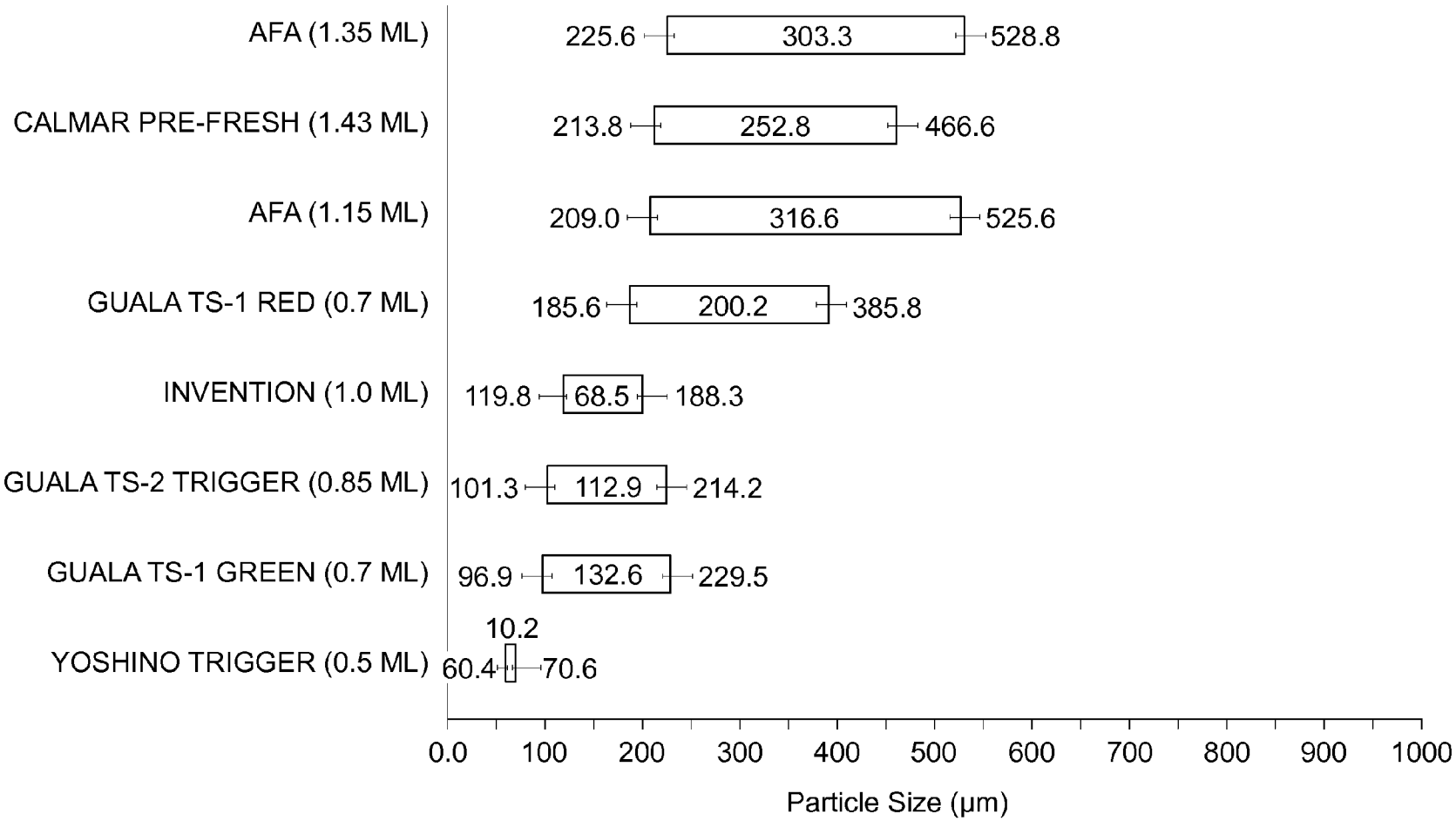
FIG. 9A is a graphical representation of a D[4,3] bimodal particle size distribution for seven commercially available sprayers and one embodiment of the present invention using distilled water as the liquid being sprayed.
Figure 9B:
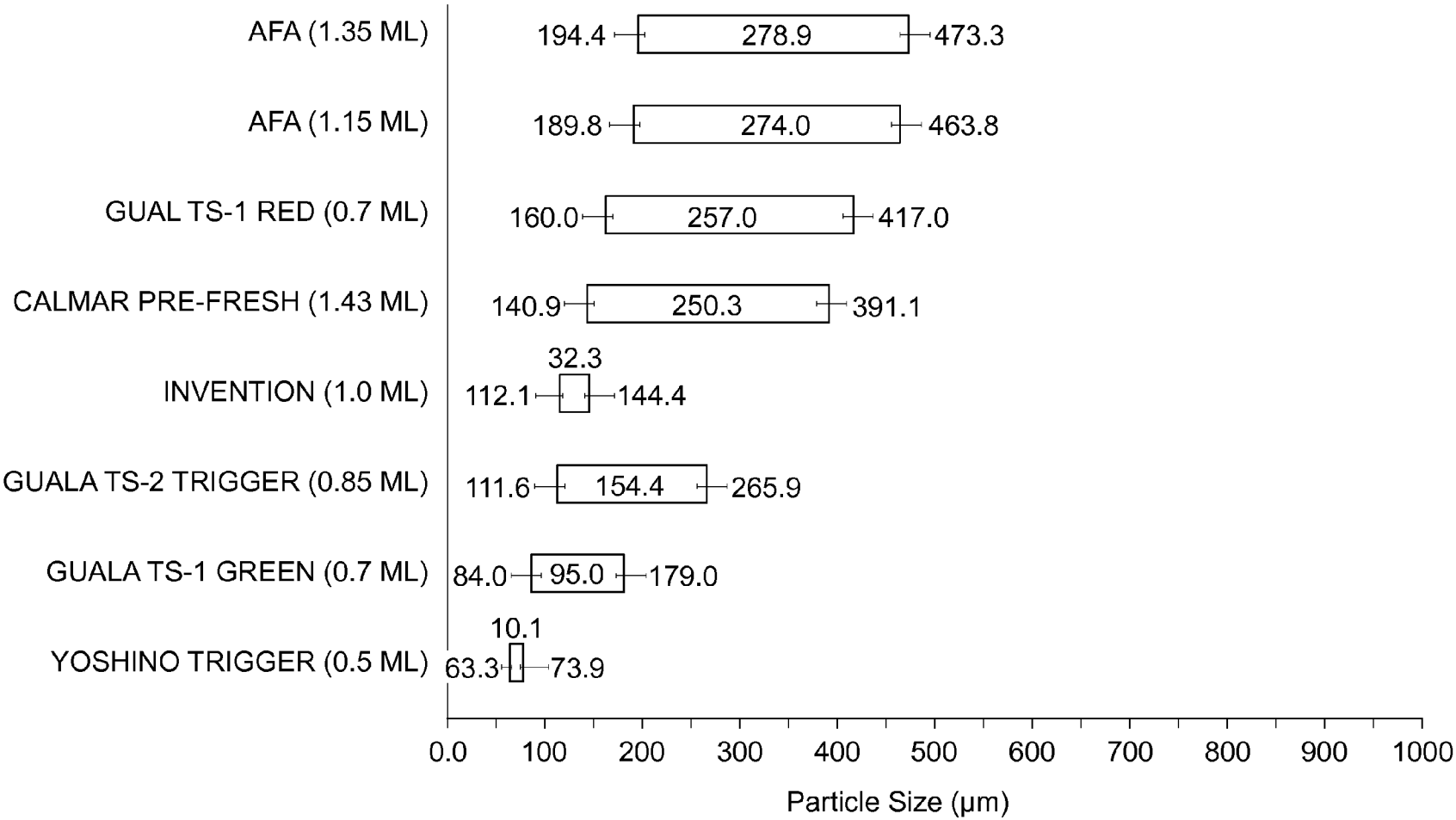

Referring to FIGS. 9A, 9B, one of skill will note that the sprayer 20 according to the present invention has a difference in D[4,3] particle size distribution between the 30 SPM stroke test and 90 SPM test of 68.5 microns. This difference decreases to 32.3 microns with the test liquid. Thus, the performance of the sprayer 20 according to the present invention advantageously improves with specific liquids of interest.

Again the Yoshino sprayer 20 had less difference between the two tests than the sprayer 20 according to the invention, but again at the sacrifice of spray volume. However, this sprayer 20 has the significant disadvantage that it only sprays out half the volume, per stroke, of the present invention. Thus, the user may become more likely to experience fatigue of the hand when using the invention or not properly dispense enough liquid to be efficacious.

Figure 10A:
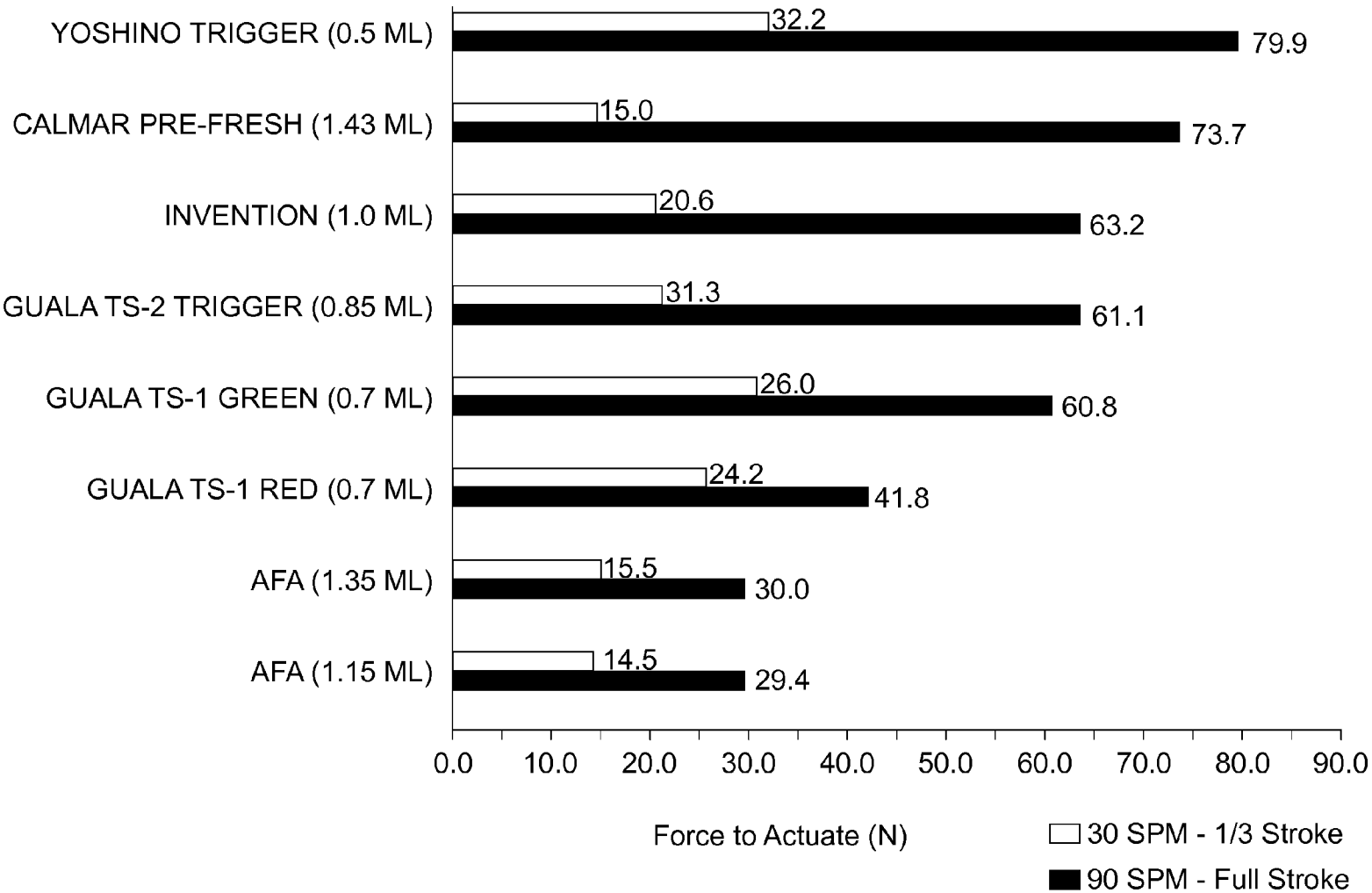
FIG. 10A is a graphical representation of the peak force necessary to acuate the trigger for seven commercially available sprayers and one embodiment of the present invention using distilled water as the liquid being sprayed.
Figure 10B:
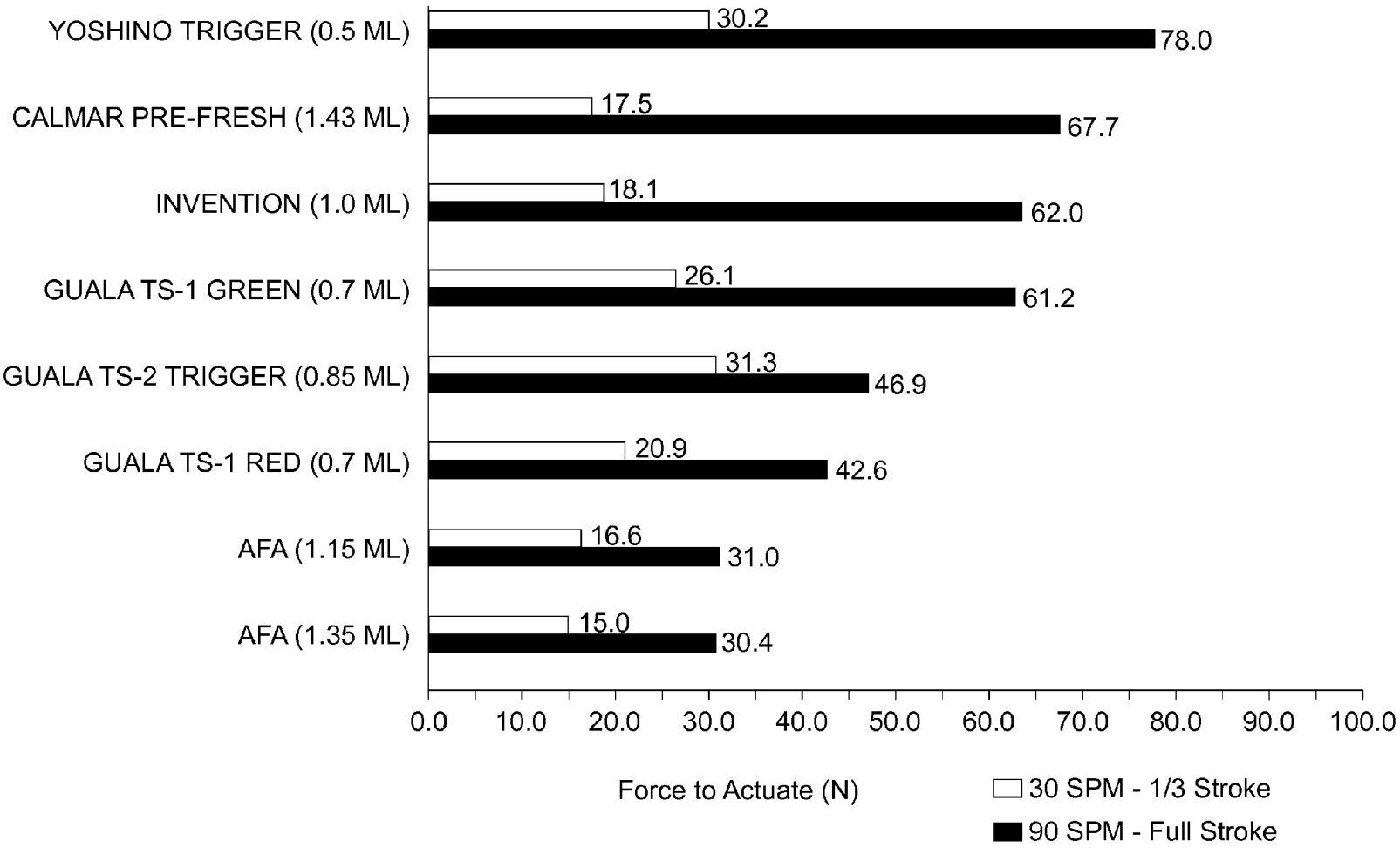
FIG. 10B is a graphical representation of the peak force necessary to acuate the trigger for seven commercially available sprayers and one embodiment of the present invention using a test liquid.

Referring to FIGS. 10A, 10B, the peak actuation force at a distance of 40 mm from the trigger 24 hinge is shown. The 90 SPM full stroke actuation force was consistently greater than the 30 SPM one-third stroke actuation force. The Yoshino sprayer 20 consistently had the highest actuation force of all sprayers tested. The sprayer 20 according to the present invention displayed a peak actuation force at the 40 mm distance from the pivot of 18.1 and 20.6 N, for the test liquid and distilled water, respectively, at 30 SPM. The peak force increased to about 62 to about 63 N when the stroke rate increased to 90 SPM.

Figure 11A:
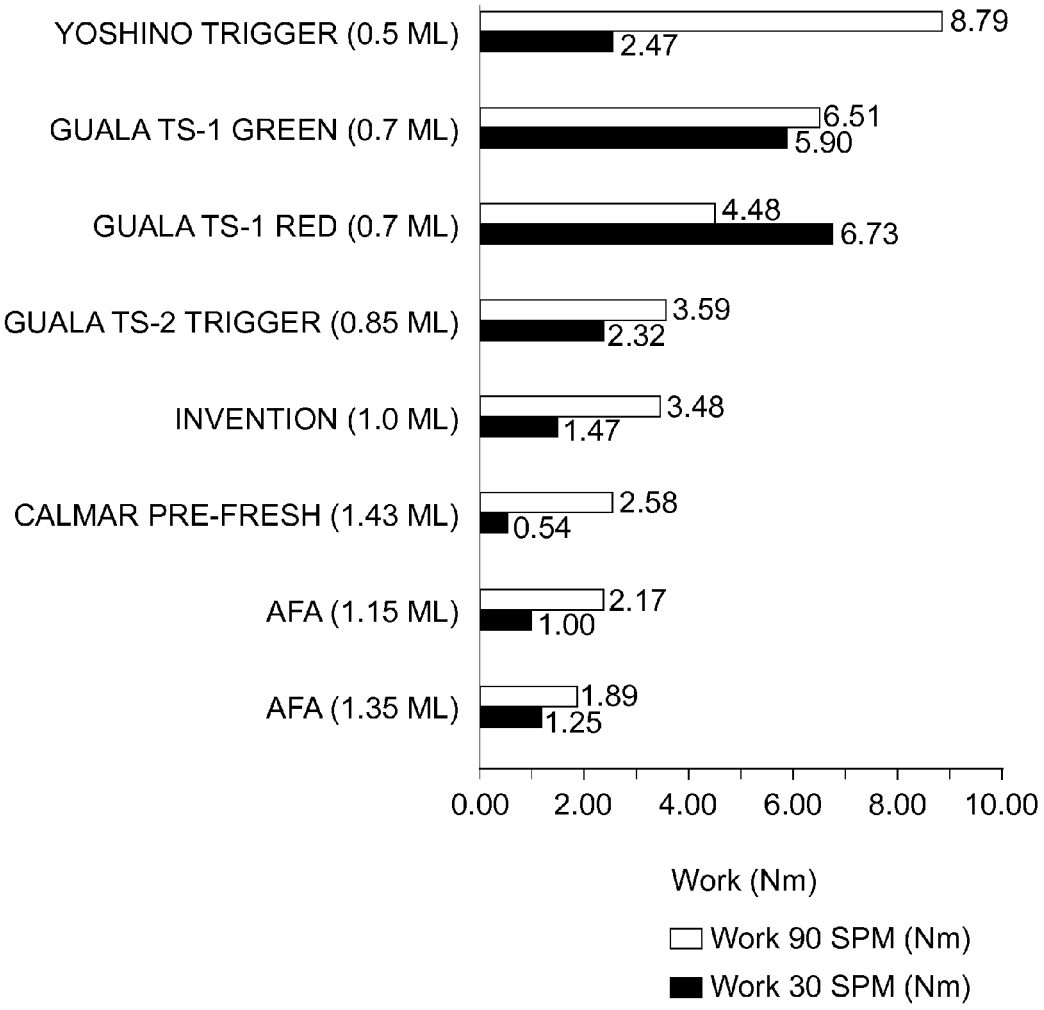
FIG. 11A is a graphical representation of the work necessary to acuate the trigger for seven commercially available sprayers and one embodiment of the present invention using distilled water as the liquid being sprayed.
Figure 11B:
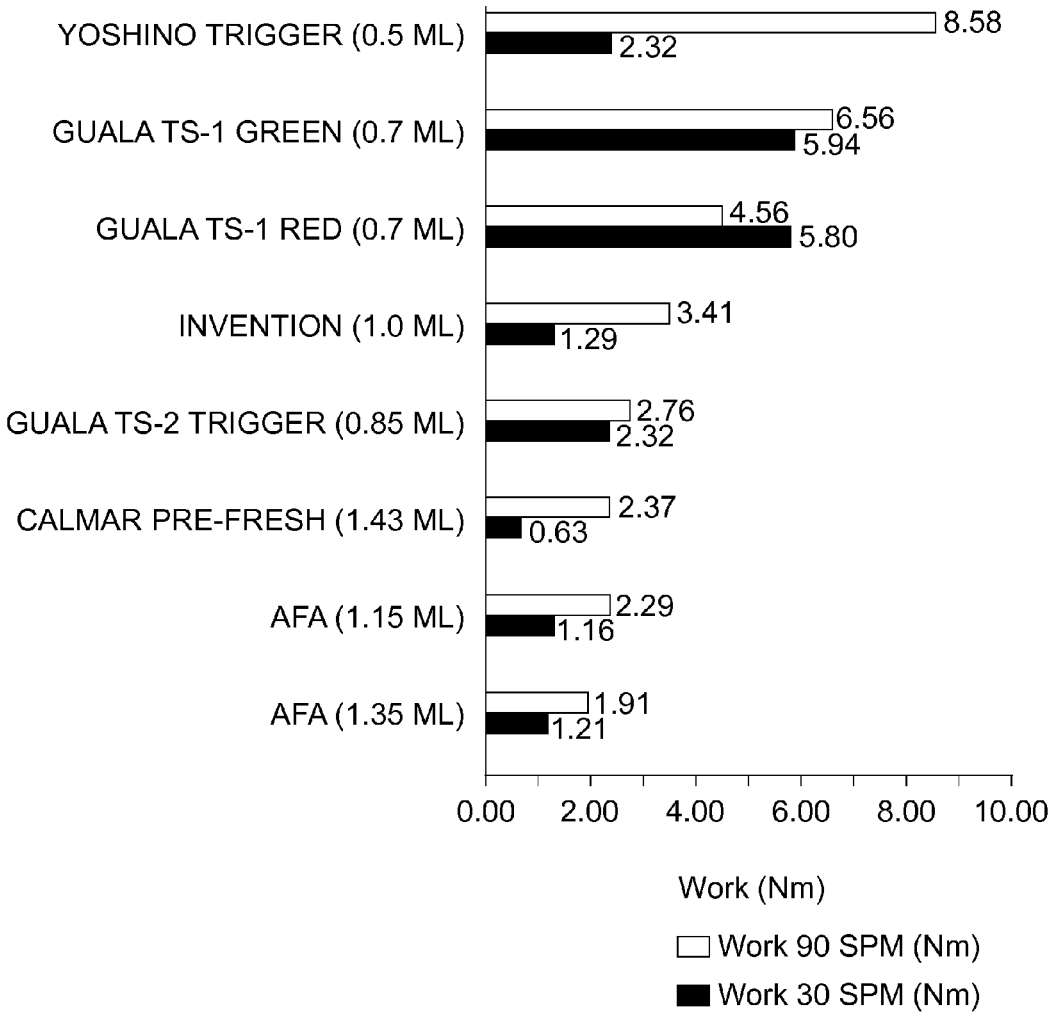
FIG. 11B is a graphical representation of the force necessary to acuate the trigger for seven commercially available sprayers and one embodiment of the present invention using a test liquid.

Referring to FIGS. 11A, 11B, the work which occurs during a single stroke at 90 SPM or one-third of a stroke at 30 SPM is shown for each sprayer 20. The work is the aforementioned peak force applied multiplied by the stroke length, and may be commonly thought of as being approximated by the area under the curve having stroke length on the abscissa and force on the ordinate axis. Only stroke length in the forward direction is considered, as this is the distance manually caused by the user. The return stroke is not considered in calculating work, as the return stroke occurs under bias of the return spring 42.

The work was measured by tallying the cumulative distance of the trigger 24 strokes, measured in a straight line, at a distance of 40 mm from the trigger 24 pivot, for the cumulative number of trigger 24 strokes necessary to provide a total spray volume of 5 ml. This cumulative distance is then multiplied by the force applied, to yield the work.

The Yoshino sprayer 20 consistently required the greatest work of all sprayers tested, despite having the lowest dispensing volume. For the present invention, the work ranged from 1.3 to 1.5 Newton meters for the test liquid and increased to about 3.4 to about 3.5 Newton meters with distilled water.

Figure 12:
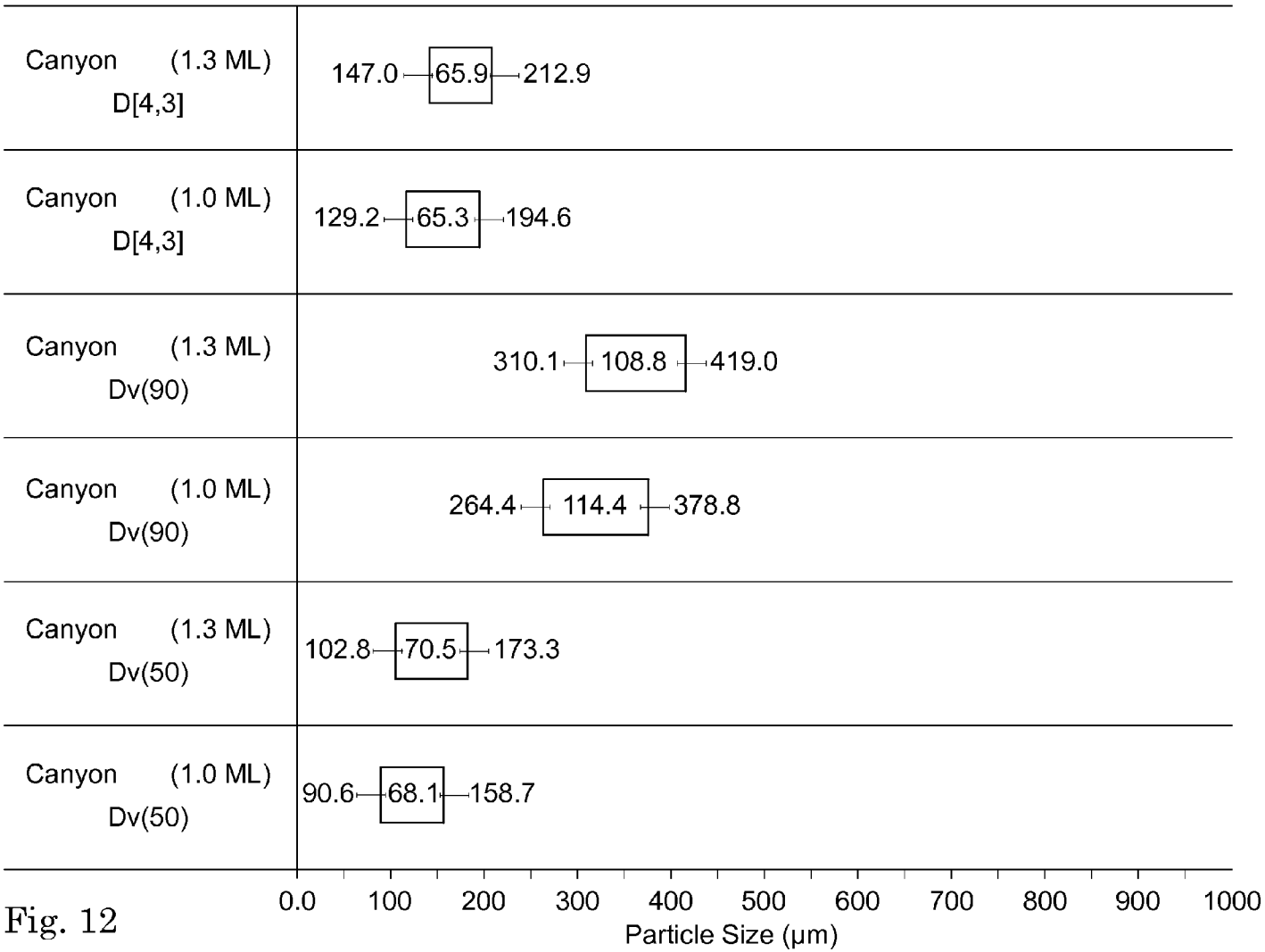
Figure 13:
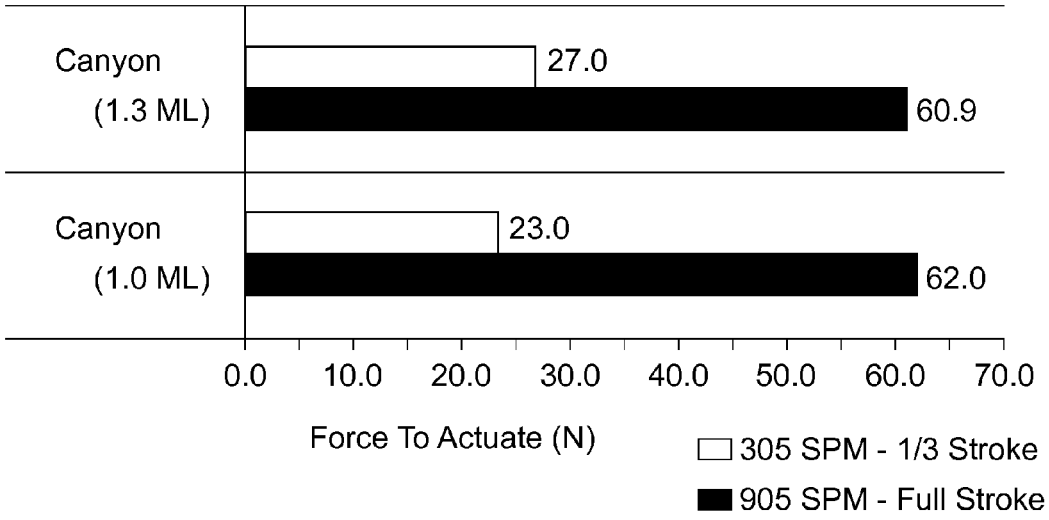
FIG. 13 is a graphical representation of the peak force necessary to acuate the trigger for two sprayers made according to WO 2009/078303 published Jun. 25, 2009, using distilled water as the liquid being sprayed. One sprayer has a 1.0 mL output per full stroke, one sprayer has a 1.3. mL output per full stroke.

Referring to FIG. 12 a graphical representation of the Dv(50), Dv(90) and D[4,3] bimodal particle size distributions for two sprayers made according to WO 2009/078303 published Jun. 25, 2009, are shown. These sprayers use distilled water as the liquid being sprayed. One sprayer has a 1.0 mL output per full stroke, one sprayer has a 1.3. mL output per full stroke. FIG. 13 is a graphical representation of the peak force necessary to acuate the trigger for two sprayers made according to WO 2009/078303 published Jun. 25, 2009, again using distilled water as the liquid being sprayed. One sprayer has a 1.0 mL output per full stroke, one sprayer has a 1.3. mL output per full stroke.

As discussed below a particle size distribution difference refers to the difference obtained testing for the respective particle size distribution at 90 SPM and 30 SPM. The test may include a sampling of n=1, or may include a sampling of n=3.

Thus the invention described and claimed hereunder, when used with distilled water, may have a Dv(50) particle size distribution difference less than 70, 60 or 50 microns but greater than 25 or 30 microns; a Dv(90) particle size distribution difference less than 200, 190, 180, 170, 160, 150 or 140 microns but greater than 60, 70, 80, 90 or 100 microns; and a D[4,3] particle size distribution difference less than 100, 90, 80, 70, or 60 microns but greater than 20, 30 or 40 microns.

The invention described and claimed hereunder, when used with the aforementioned test liquid, may have a Dv(50) particle size distribution difference less than 60, 50, 40 or 30 microns but greater than 15, 20 or 25 microns; a Dv(90) particle size distribution difference less than 175, 150 or 75 microns but greater than 625 or 50 microns; and a D[4,3] particle size distribution difference less than 90, 80, 70, 60 or 50 microns but greater than 20, 25 or 30 microns.

The invention described and claimed hereunder, when used with distilled water, may have a peak actuation force at a distance of 40 mm from the trigger 24 pivot of less than less than 70 or 65 Newtons, but greater than 35, 40 or 50 Newtons at 90 SPM; and less than 30, 25 or 20 Newtons, but greater than 10 or 15 Newtons at 30 SPM.

The invention may be used with a liquid having a surface tension of at least 20, 21, 22, 23, 24 or 25 and less than 75, 74, 73, 72, 71, or 70 mNewtons/meters; a kinematic viscosity of at least 8.7 E-4, 8.8 E-4, 8.9 E-4 or 9E-4 and/or less than 0.0015, 0.0014, 0.0013, 0.0012, 0.0011 or 0.0010 Pascal seconds at 25 C; and/or a dynamic viscosity less of at least 0.87, 0.88, 0.89, 0.9 and less than 1.15, 1.14, 1.13, 1.12, 1.11 or 1.10 centipoises at 25 C.

The invention described and claimed hereunder, when used with the aforementioned test liquid, may have a peak actuation force at a distance of 40 mm from the trigger 24 pivot of less than less than 75, 70 or 65 Newtons, but greater than 35, 40 or 50 Newtons at 90 SPM; and less than 30, or 20 Newtons, but greater than 10 or 15 Newtons at 30 SPM.

The invention described and claimed hereunder, when used with distilled water or the aforementioned test liquid, may have work to dispense 5 mL of distilled water or test liquid, respectively, less than 8, 7.5, 7.0, 6.5, 6.0, 5.5, 5.0, 4.5 or 4.0, but greater than 3.0 or 3.5 Newton meters at 90 SPM and less than 5, 4.5, 4.0, 3.5, 3.0, 2.5, 2.0 or 1.5, but greater than 0.5, 1 or 1.25 Newton meters at 30 SPM.

The trigger sprayer of the present invention may dispense at least 0.6, 0.7, 0.8, 0.9, 1.0, 1.1 or 1.2, but less than 2.0, 1.9, 1.8, 1.7 1.6 or 1.5 ml of a liquid contained in the reservoir 22 per full stroke of the trigger 24 at 90 SPM. The trigger sprayer of the present invention may dispense at least 0.20, 0.25, 0.30, but less than 0.60, 0.55, or 0.5 ml of a liquid contained in the reservoir 22 per one-third stroke of the trigger 24 at 30 SPM.

All percentages stated herein are by weight unless otherwise specified. It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A trigger sprayer for use with a spray system, said trigger sprayer comprising:

an articulable trigger, a pump operably connected to said trigger, whereby articulation of said trigger causes corresponding reciprocation of a piston in said pump, said reciprocation of said piston drawing distilled water liquid from a reservoir and discharging said liquid through a nozzle, said liquid being discharged through said nozzle into particles, said particles having a particle size inversely related to the rate at which said trigger is articulated, whereby said difference in particle size distribution between 30 spm and 90 spm is less than:

70 microns for a Dv(50) particle size distribution, and/or 200 microns for a Dv(90) particle size distribution, and/or 90 microns for a D[4,3] particle size distribution, said discharge occurring with less than:

6 Nm of work at 90 SPM and/or

2 Nm of work at 30 SPM.

2. A trigger sprayer according to claim 1 wherein said difference in particle size distribution between 30 spm and 90 spm is less than:

60 microns for a Dv(50) particle size distribution, and/or 170 microns for a Dv(90) particle size distribution, and/or 80 microns for a D[4,3] particle size distribution.

3. A trigger sprayer according to claim 2 wherein said difference in particle size distribution between 30 spm and 90 spm is less than:

150 microns for a Dv(90) particle size distribution, and/or 70 microns for a D[4,3] particle size distribution.

4. A trigger sprayer according to claim 2 wherein said articulable trigger is articulable about a hinge, and the wherein said force to actuate said trigger at a distance of 40 mm from said hinge is less than:

70 N at a stroke rate of 90 SPM and/or

25 N at a stroke rate of 30 SPM.

5. A trigger sprayer according to claim 1 which dispenses at least 1 ml of distilled water per stroke of the trigger.

6. A trigger sprayer for use with a spray system, said trigger sprayer comprising:

an articulable trigger, a pump operably connected to said trigger, whereby articulation of said trigger causes corresponding reciprocation of a piston in said pump, said reciprocation of said piston drawing a liquid from a reservoir, and discharging said liquid through a nozzle, said liquid having a surface tension of 23.1 mNewtons/meter, a kinematic viscosity of 0.00114 Pascal seconds at 25 C, and a dynamic viscosity of 1.14 centipoises at 25 C, said liquid being discharged through said nozzle into particles, said particles having a particle size inversely related to the rate at which said trigger is articulated, whereby said difference in particle size distribution between 30 spm and 90 spm is less than:

50 microns for a Dv(50) particle size distribution, and/or 150 microns for a Dv(90) particle size distribution, and/or 70 microns for a D[4,3] particle size distribution, said discharge occurring with less than:

6 Nm of work at 90 SPM and/or

2 Nm of work at 30 SPM.

7. A trigger sprayer according to claim 6 wherein said difference in particle size distribution between 30 spm and 90 spm is less than:

40 microns for a Dv(50) particle size distribution, and/or 100 microns for a Dv(90) particle size distribution, and/or 60 microns for a D[4,3] particle size distribution.

8. A trigger sprayer according to claim 7 wherein said difference in particle size distribution between 30 spm and 90 spm is less than:

30 microns for a Dv(50) particle size distribution, and/or 75 microns for a Dv(90) particle size distribution, and/or 50 microns for a D[4,3] particle size distribution.

9. A trigger sprayer according to claim 7 wherein said articulable trigger is articulable about a hinge, and the wherein said force to actuate said trigger at a distance of 40 mm from said hinge is less than:

70 N at a stroke rate of 90 SPM and/or

25 N at a stroke rate of 30 SPM.

10. A trigger sprayer according to claim 7 which dispenses at least 1 ml of said liquid per stroke of the trigger.

11. A trigger sprayer for use with a spray system, said trigger sprayer comprising:

an articulable trigger, a pump operably connected to said trigger, whereby articulation of said trigger causes corresponding reciprocation of a piston in said pump, said reciprocation of said piston being able to draw a liquid from a reservoir, and discharging said liquid through a nozzle, said liquid being discharged through said nozzle into particles said liquid having a kinematic viscosity ranging from 8.9 E-4 to 0.0011 Pascal seconds at 25 C, a dynamic viscosity ranging from 0.89 to 1.1 centipoises, a surface tension ranging from 20 to 75 milliNewtons per meter, said particles having a particle size inversely related to the rate at which said trigger is articulated, whereby particles have a particle size distribution corresponding to:

a Dv(50) particle size of 95 microns+10% at 90 SPM and 120 microns+10% at 30 SPM, and/or a Dv(90) particle size of 195 microns+10% at 90 SPM and 260 microns+10% at 30 SPM, and/or a D[4,3] particle size of 110 microns+10% at 90 SPM and 145 microns+10% at 30 SPM, and/or said discharge occurring with less than:

6 Nm of work at 90 SPM and/or

2 Nm of work at 30 SPM.

12. A trigger sprayer according to claim 11 wherein said articulable trigger is articulable about a hinge, and the wherein said force to actuate said trigger at a distance of 40 mm from said hinge is less than:

70 N at a stroke rate of 90 SPM and/or

25 N at a stroke rate of 30 SPM.

13. A trigger sprayer according to claim 11 which dispenses at least 1 ml of said liquid per stroke of the trigger.

* * * * *